United States Patent [19]

Killestijn

[11] Patent Number: 4,798,302

[45] Date of Patent: Jan. 17, 1989

[54] CLOSING DEVICE FOR A HOLDER AND DIAPHRAGM FOR SUCH A DEVICE

[75] Inventor: Cornelis Killestijn, Prinsenbeek, Netherlands

[73] Assignee: Skillpack B.V., Etten-Leur, Netherlands

[21] Appl. No.: 174,205

[22] Filed: Mar. 28, 1988

[30] Foreign Application Priority Data

Apr. 13, 1987 [NL] Netherlands ..... 8700871
Jan. 20, 1988 [EP] European Pat. Off. ..... 88200101.9

[51] Int. Cl.[4] ..... B65D 39/12; B65D 53/00
[52] U.S. Cl. ..... 215/271; 215/231
[58] Field of Search ..... 215/231, 271, 277, 230; 220/256, 85 B

[56] References Cited

U.S. PATENT DOCUMENTS 2,040,798 5/1936 Schoonmaker ..... 215/271
4,174,784 11/1979 Hartung ..... 215/271

*Primary Examiner*—George T. Hall
*Attorney, Agent, or Firm*—John P. Snyder

[57] ABSTRACT

A deformable holder is safeguarded against visible implosion by a diaphragm between cover and holder. The space between diaphragm and cover is in contact with the atmosphere via passages between diaphragm and cover, while the holder is hermetically closed off from the outer air by the diaphragm.

7 Claims, 3 Drawing Sheets

CLOSING DEVICE FOR A HOLDER AND DIAPHRAGM FOR SUCH A DEVICE

The invention relates to a closing device according to the preamble of claim 1.

Such a closing device is known from CH-A-443951. This prevents a thin-walled holder imploding in an unacceptably visible manner should an underpressure occur in the holder, since a space present between the cover and the diaphragm is in contact with the atmosphere via a small opening arranged in the centre of the cover.

The invention has for its aim to provide a holder of thin-walled and easily deformable material which can be opened repeatedly and hermetically closed off from the outside air, whereby implosion in the case of a possibly occurring underpressure is prevented without a central opening in the cover.

To this end, the feature of claim 1 is applied.

The invention likewise relates to a diaphragm for such a closing device. It is remarked that a closing device for a holder is known whereby a paste is released by squeezing in the holder. In order to ensure that the holder assumes its original shape after being squeezed, communication with the atmosphere is effected between a cover and a diaphragm via grooves arranged in the diaphragm and via an opening arranged in the diaphragm. During storage the contents of the holder are in contact with the atmosphere, which is precisely opposed to the object of the current invention.

The invention will be elucidated in the description following hereinafter with reference to drawings. In the drawings.

Figure 3:
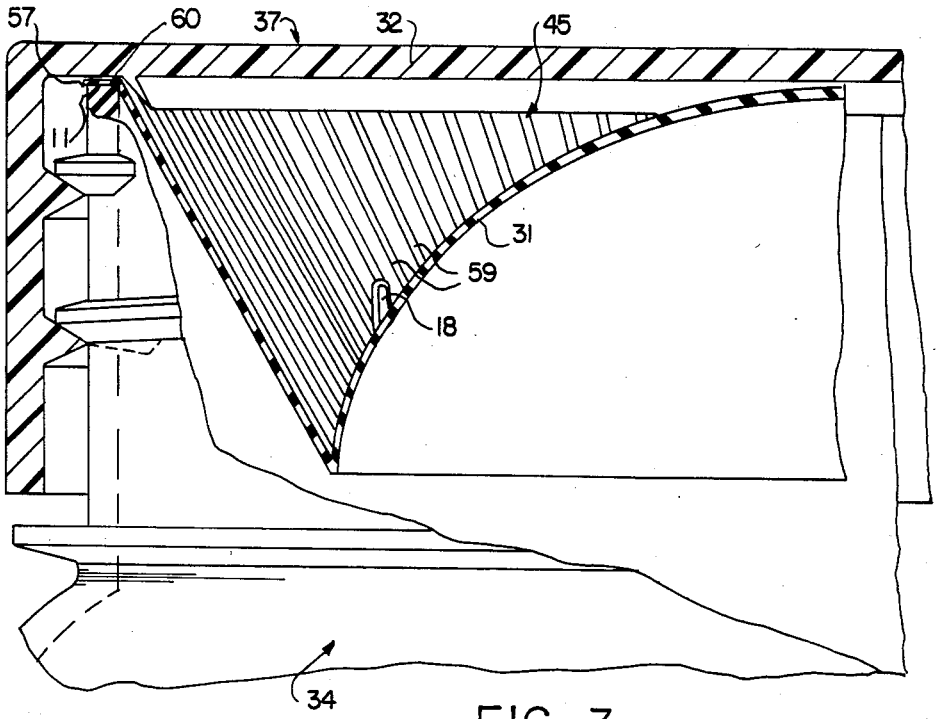
Figure 4:
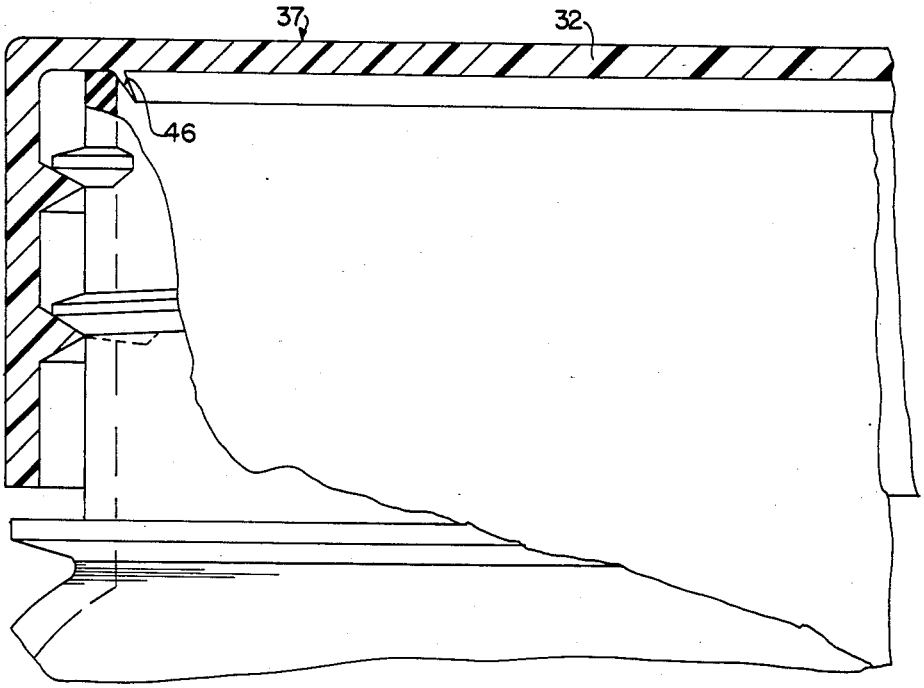

FIG. 3, 5, 6 and 7 each show a longitudinal section in each case through a different holder with a different closing device according to the invention; and FIG. 4 shows a longitudinal section similar to fig. 3 in another closing position.

A holder 4, for example a jar or a bottle, particularly for food products, medicine and the like, has a neck 3 with screw thread 5, the neck bounding an opening 6. Opening 6 is closed by means of a closing device 7 according to the invention, comprising a cover 2 which grips on screw thread 5 with internal thread 8 and which is arranged over opening 6. Instead of a screw thread connection a bayonet closure may be applied. Arranged between opening 6 and cover 2 is a diaphragm 1 of closure 7. The diaphragm 1 has a form essentially deviating from a flat shape, since the diaphragm lies with its edge 10 on the upper edge 11 of holder opening 6, and from there extends downward at a sloping angle a and inward into a bend 12. The central part 13 located inside bend 12 is dome-shaped. The diaphragm 1 is for example manufactured from polyethylene which is soft and can easily be deformed elastically. Present on the top of edge 10 are a number of grooves 14 distributed over the periphery and arranged between ribs in order to place the space 15 between cover 2 and diaphragm 1 in contact with the atmosphere. The edge 10 of diaphragm 1 is on the other hand pressed so tightly onto edge 11 of the neck by means of cover 2, that diaphragm 1 closes off holder 4 hermetically. In the case a vacuum should arise in the holder, for example because of cooling of the food product contents of holder 4 and/or condensation of vapour present in holder 4, the diaphragm 1 will move downward while it deforms and air escapes into space 15 via grooves 14.

When holder 4 is opened for use, cover 2 is unscrewed and diaphragm 1 is removed and thrown away. A lip 18 is present for gripping the diaphragm. After removal of part of the contents, holder 4 can be closed hermetically with cover 2 whereby an internal, deformable lip 16 of cover 2 makes a sealing connection to top edge 11. The thin-walled holder 4 can consist for example of polyester with a wall thickness of 0.4–0.6 mm with a content of several litres, decilitres or centilitres.

If the diaphragm is very elastic, it may possibly be flat in the starting position. It is also conceivable that diaphragm 1 from FIG. 1 is manufactured of a thin plastic deformable material such as deep drawn polystyrene with a wall-thickness of 0.1–0.2 mm, or of deep drawn thin aluminum.

Figure 1:
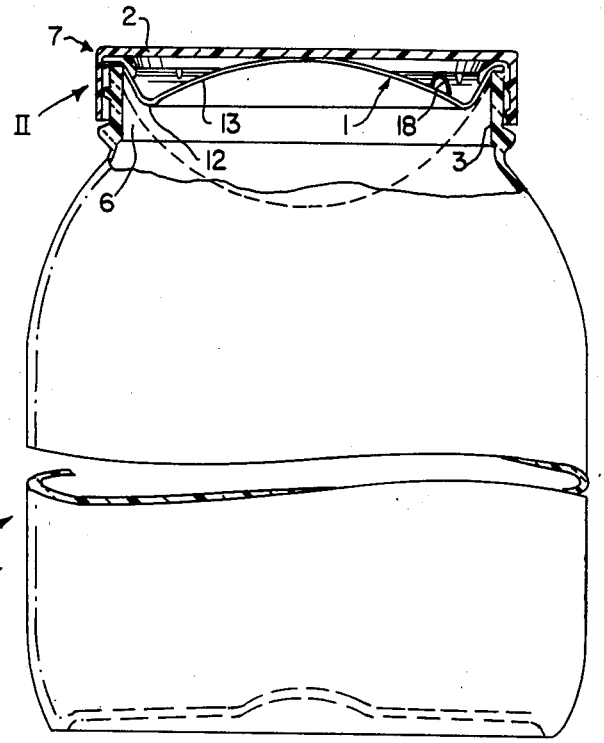
FIG. 1 shows a longitudinal section through a holder having a preferred embodiment of a closing device according to the invention.
Figure 2:
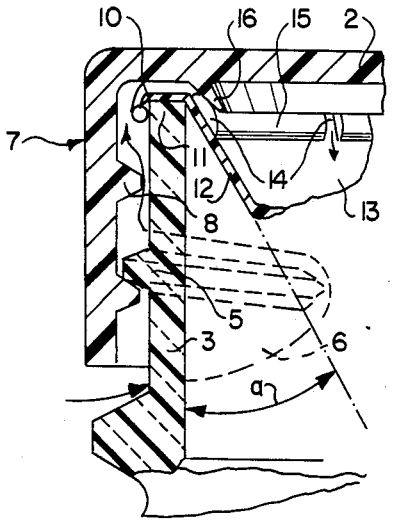
FIG. 2 shows on a larger scale a fraction II from FIG. 1.

Diaphragm 1 from FIG. 1 has a lip 18 with which it can easily be pulled off opening 6. Diaphragm 1 preferably consists of polyethylene. Cover 2 preferably consists of polypropylene. Closing device 7 is preferably pre-assembled as a whole, whereby edge 10 is accommodated for locking at the lip 16 of cover 2, so that the closing device 7 can be supplied integrally to a closing machine and a holder 4 can be closed by the closing machine in one operation.

The closing device 37 from FIG. 3 comprises a cover 32 with a diaphragm 31 which lies with its edge 57 for sealing against the top edge 11 of holder 34 which is identical to holder 4 from FIG. 1. This thin diaphragm 31 again has a non-flat, easily deformable shape. A space 45 between diaphragm 31 and cover 32 is in contact with the atmosphere via grooves 60 between ridges 58 lying on edge 57. The lip 46 of cover 32 closes off holder 34 hermetically when, as according to fig. 4, diaphragm 31 is removed by gripping on a lip 18. When as according to FIG. 3 the diaphragm 31 is in fact present, the lip 46 rests on ribs 59 so that air can pass between ribs 59 and lip 46. The closing pressure is realized in FIG. 3 and 4 through internal screw thread 8 on cover 32 and internal screw thread or screw thread pieces 5 on the holder neck 3.

Figure 6:
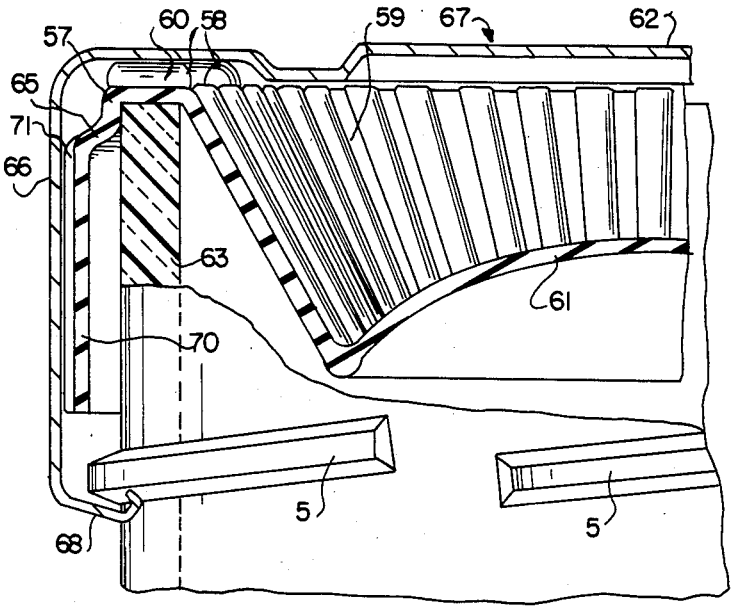
Figure 7:
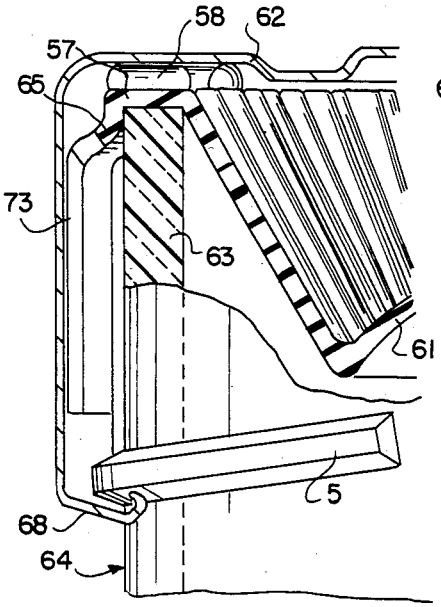
Figure 5:
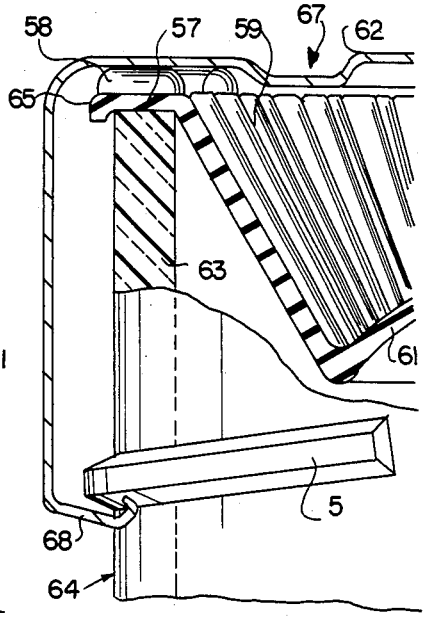

Each closing device 67 from FIG. 5, 6 and 7 corresponds to that from FIG. 3, with the exception that cover 62 is manufactured of sheet metal and has the form of a conventional jam jar cover, with the difference however that the conventional elastic sealing lining therein is omitted and replaced by a diaphragm 61. This diaphragm 61 is of elastically deformable material, such as plastic, for example thin polyethylene, whereby ribs 59 and ridges 58 are again present. An annular collar 65 is arranged on diaphragm 61 outside holder neck 63 and inside cover edge 66. When cover 62 is screwed off the neck 63 on holder 64, collar 65 in FIG. 5 cooperates directly with the bayonet edge 68 of cover 62 to remove diaphragm 61 from neck 63.

In FIG. 6, collar 65 has a collar element 70 hanging from it which co-operates with bayonet edge 68, this collar element 70 being provided with ridges 71 to ensure the passage of air between collar element 70 and cover edge 66.

In FIG. 7 hanging fingers 73 are arranged on collar 65 to keep the diaphragm at a constant depth in the cover 62 removed from holder 64.

I claim:

1. Closing device (7, 37, 67) for closing a holder opening (6) comprising at least a cover (2, 32, 62) arranged over said opening (6) and a diaphragm (1, 31, 61) arranged between an edge (11) of said holder opening (6) and said cover (2, 32, 62), said diaphragm being essentially elastically and/or plastically deformable in its plane, and/or having a shape which in unloaded state deviates essentially from the flat form, whereby a space (15, 45) present between cover (2, 32, 62) and diaphragm (1, 31, 61) is in contact with the atmosphere via at least one passage (14, 60), characterized in that said diaphragm (1, 31, 61) has on the upper side of its edge (10, 57) at least one groove (14, 60) for placing said space (15) present between cover (2, 32, 62) and diaphragm (1, 31, 61) in contact with the atmosphere, and that present between holder (4, 34, 64) and cover (2, 32, 62) are active connecting means (5, 8, 68), each of which are releasable.

2. Closing device (7, 37) as claimed in claim 1, characterized in that the diaphragm (1, 31, 61) has at least one groove (14) between diaphragm (1, 31) and a lip (46) which is arranged on the cover (2, 32) and which is close fitting on the opening edge of the holder (4), when said diaphragm (1, 31) is removed.

3. Closing device (67) as claimed in claim 1 or 2, characterized in that the cover (62) is manufactured of a stiff material, for example metal, that an air tight sealing is realized between the holder edge (63) and the underside of the edge (57) of the diaphragm (61), and that said diaphragm (61) is provided with coupling means (65, 70, 73) for coupling said diaphragm (61) with said cover (62).

4. Closing device (67) as claimed in claim 3, characterized in that the coupling means (65, 70, 73) are arranged on the outer periphery of the diaphragm (61).

5. Closing device (67) as claimed in any of the preceding claims, characterized in that the diaphragm (61) is provided on its outer periphery with downward hanging coupling means (70, 73) which co-operate for coupling with an edge (68) of the cover (62).

6. Closing device (67) as claimed in claim 5, characterized in that the coupling means consist of downward hanging fingers (73).

7. Diaphragm (1, 31, 61) evidently intended for a closing device (7, 37, 67) as claimed in any of the preceding claims.

* * * * *